US008793884B1

(12) United States Patent
Chen

(10) Patent No.: US 8,793,884 B1
(45) Date of Patent: Aug. 5, 2014

(54) CIRCLE CUTTING TOOL

(76) Inventor: Chi-Jen Chen, Xihu Township, Changhua County (TW)

( * ) Notice: Subject to any disclaimer, the term of this patent is extended or adjusted under 35 U.S.C. 154(b) by 145 days.

(21) Appl. No.: 13/440,328

(22) Filed: Apr. 5, 2012

(51) Int. Cl.
*B26D 1/12* (2006.01)
*B43L 9/00* (2006.01)

(52) U.S. Cl.
USPC ..... 30/310; 83/745; 33/27.01

(58) Field of Classification Search
USPC ..... 30/286, 300, 310, 360, 320; 33/31, 33/27.03, 27.031, 27.032; 83/490, 745
See application file for complete search history.

(56) References Cited

U.S. PATENT DOCUMENTS 5,007,320 A * 4/1991 Craig et al. ..... 83/745
6,286,216 B1 * 9/2001 Braun ..... 30/310
7,685,719 B2 * 3/2010 Hogan et al. ..... 30/310
2002/0162228 A1 * 11/2002 Lee ..... 30/310
2011/0214299 A1 * 9/2011 Heh ..... 30/310
2011/0302792 A1 * 12/2011 Exley et al. ..... 30/310
2012/0042525 A1 * 2/2012 Chiu et al. ..... 30/310

* cited by examiner

*Primary Examiner* — Laura M Lee
(74) *Attorney, Agent, or Firm* — Egbert Law Offices, PLLC

(57) ABSTRACT

An improved structure of a circle-cutting tool has an outer ring seat having a round hollow groove and a placing surface. A rotary disc is pivoted into the round hollow groove of the outer ring seat for rotation in relation to the outer ring seat, and has a top surface, bottom surface, outer ring portion and central portion. An elongated through groove penetrates through the top and bottom surfaces of the rotary disc in an elongated shape. The elongated through groove is set in a way to be extended from the central portion of the rotary disc to the outer ring portion. An adjustable elastic cutting assembly is pivoted into the elongated through groove in a slidable state in relation to the elongated through groove.

3 Claims, 8 Drawing Sheets

CIRCLE CUTTING TOOL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a circle-cutting tool, and more particularly to an innovative one which is designed to maintain optimum torque and flexible cutting functions.

2. Description of Related Art Including Information Disclosed Under 37 CFR 1.97 and 37 CFR 1.98

According to common circle-cutting methods, some circular lines are drawn on the surface of soft flat objects (e.g.: paper and plastic plate) by using a compass or circular items, which are then tailored linearly by utility knives or scissors. So, a special circle-cutting tool has been designed in response to the time-consuming method that affects the circular degree.

A common circle-cutting tool comprises a turnplate and a cutter, of which the turnplate is provided with a plurality of through holes, so the cutter could be inserted to rotate the turnplate for cutting. However, the following shortcomings are observed during actual applications:

First, as the torque of force applied by common circle-cutting tool refers to the distance between through hole and center of the turnplate, a smaller torque may lead to difficulty in application of force if a circle of smaller radius is to be cut.

Second, as the depth of through hole in the turnplate is shallow, this may give rise to hazards in case disengagement of the cutter occurs due to improper application of force by the users. Furthermore, precise coordination shall be required between through hole and cutter, otherwise the operation of cutting is prone to deviation, thus affecting the circular degree of circle.

Third, as manual insertion is adopted for said cutter, it is difficult to control the strength of force to be applied, and deep insertion may cause difficulty in application of force when cutting items of certain thickness.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

Based on the unique structural design of the present invention wherein the "improved structure of circle-cutting tool" mainly comprises: an outer ring seat, rotary disc, elongated through groove and adjustable elastic cutting assembly, when the circle-cutting tool is used to cut circles, the adjustable elastic cutting assembly allows to slidably adjust the size of circles, and the rotary disc could be rotated through its outer ring portion, such that optimum torque could be maintained in cutting big or small circles. Moreover, the adjustable elastic cutting assembly enables flexible cutting in line with the thickness of the objects by consistent and uniform force, thus realizing more easier and smooth cutting process.

Based on the characteristics that the adjustable elastic cutting assembly is set into the elongated through groove of the rotary disc and the cutter could be retracted into the base body, the present invention could be used more flexibly without the possibility of being damaged by the cutter, thus improving dramatically its safety with better applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

FIGS. 1-8 depict preferred embodiments of the improved circle-cutting tool of the present invention, which, however, are provided for only explanatory objective for patent claims.

The circle-cutting tool A comprises an outer ring seat 10, comprising of a round hollow groove 11 and a placing surface 12. The outer ring seat 10 could prevent the sliding of the objects from interfering with the cutting process by pressing the targeted objects with the placing surface 12.

Figure 2:
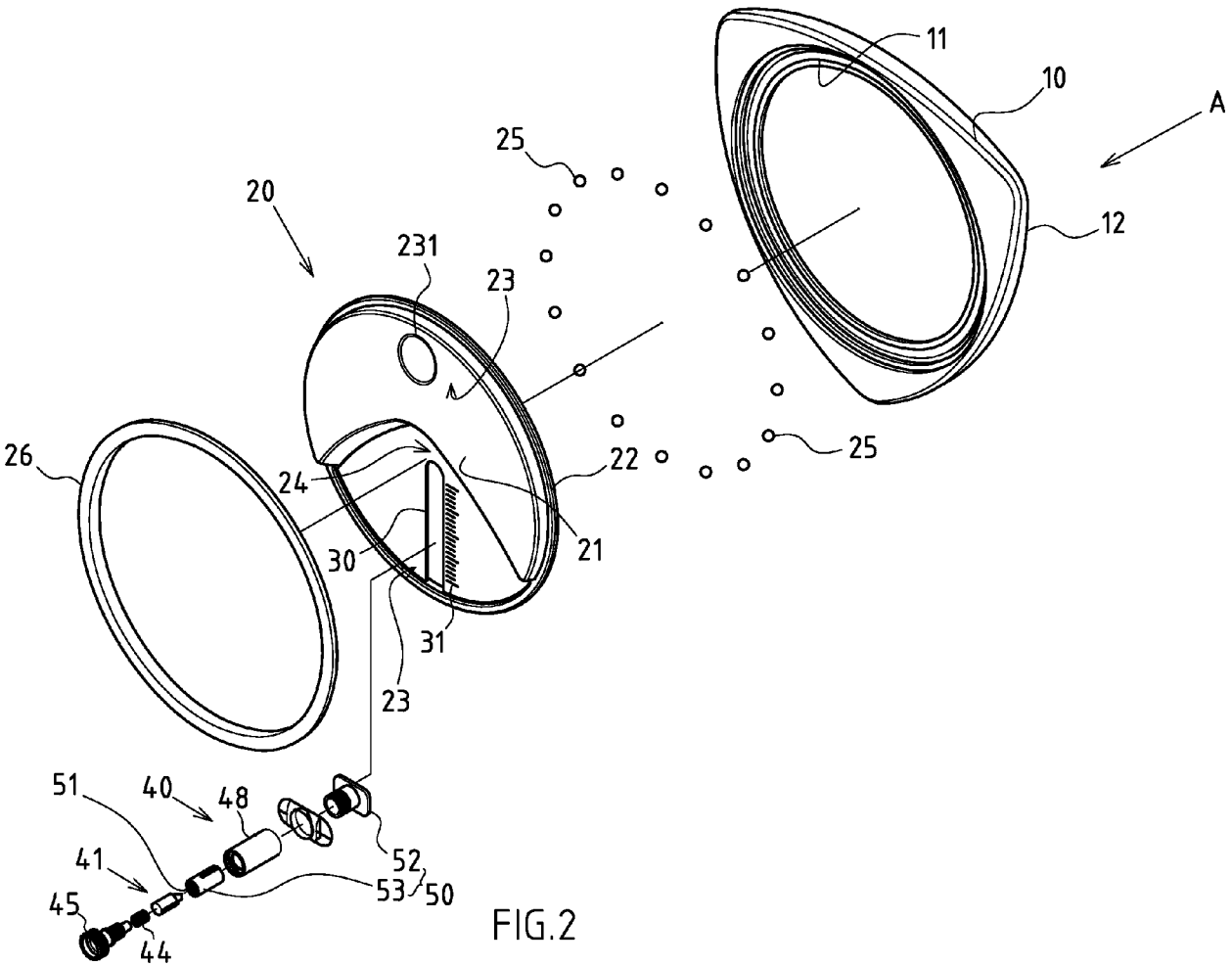
FIG. 2 is an exploded perspective view of the present invention.

A rotary disc 20 is pivoted into the round hollow groove 11 of the outer ring seat 10 for rotation in relation to the outer ring seat 10. It comprises of a top surface 21, a bottom surface 22, outer ring portion 23 and central portion 24. Of which the height of the bottom surface 22 of the rotary disc 20 is equal to that of the placing surface 12 of the outer ring seat 10, so that the placing surface 12 of the outer ring seat 10 could press the objects. Referring to FIG. 2, the rotary disc 20 allows a plurality of balls 25 and a retaining ring cover 26 to be pivoted into the round hollow groove 11 of the outer ring seat 10, so that the rotary disc 20 could be rotated in relation to the outer ring seat 10. Also, the rotary disc 20 is made of transparent materials.

An elongated through groove 30 penetrates through the top surface 21 and bottom surface 22 of the rotary disc 20 in an elongated shape. The elongated through groove 30 is set in a way to be extended from the central portion 24 of the rotary disc 20 to the outer ring portion 23 (shown in FIG. 2).

An adjustable elastic cutting assembly 40 is pivoted into the elongated through groove 30 in slidable state in relation to the elongated through groove 30. Said adjustable elastic cutting assembly 40 comprises a holding base 50, a cutter 41, an elastic element 44 and an adjusting part 45. The holding base 50 comprises of a holding space 51. The cutter 41 is set into the holding space 51 of the holding base 50, and composed of a blade 42 and a cutting base 43. Said elastic element 44 is set into the holding space 51 of the holding base 50, thus generating an elastic force for the cutting base 43 of the cutter 41. Said adjusting part 45 is set into the holding space 51 of the holding base 50, so that the cutter 41 could slide in relation to the holding base 50.

Figure 3:
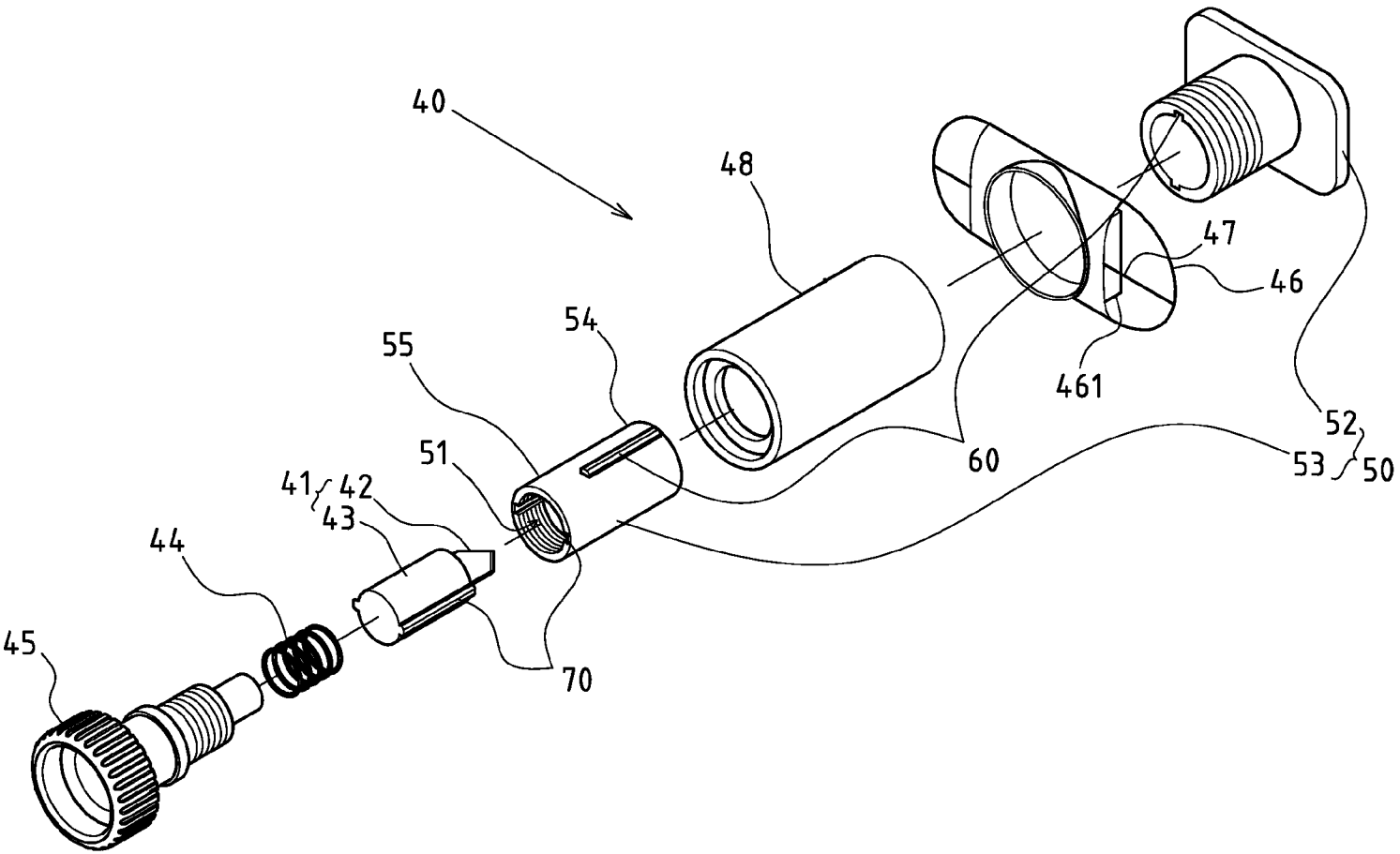
FIG. 3 is an exploded perspective view of the adjustable elastic cutting assembly of the present invention.

Of which, the holding base 50 comprises of a base body 52 and a driven tube 53 set into the base body 521. Said holding space 51 is formed in the driven tube 53, and said driven tube 53 comprises of an actuating end 54 and a regulating end 55. Said cutter 41 is set at the actuating end 54 of the driven tube 53, while the actuating end 54 is provided with a through-hole 541 from which the blade 42 of the cutter 41 can be protruded. The adjusting part 45 is set at the regulating end 55 of the driven tube 53, while the elastic element 44 is set between the adjusting part 45 and the cutter 41. Moreover, the driven tube 53 can slide in relation to the base body 52 via a first radial spacing part 60, whilst the cutter 41 can slide in relation to the driven tube 53 via a second radial spacing part 70. Referring to FIG. 3, the first and second radial spacing parts 60, 70 are designed into the combination of protruding column and groove, so that the driven tube 53 and the base body 52, or the cutter 41 and the driven tube 53 can slide axially.

Figure 4:
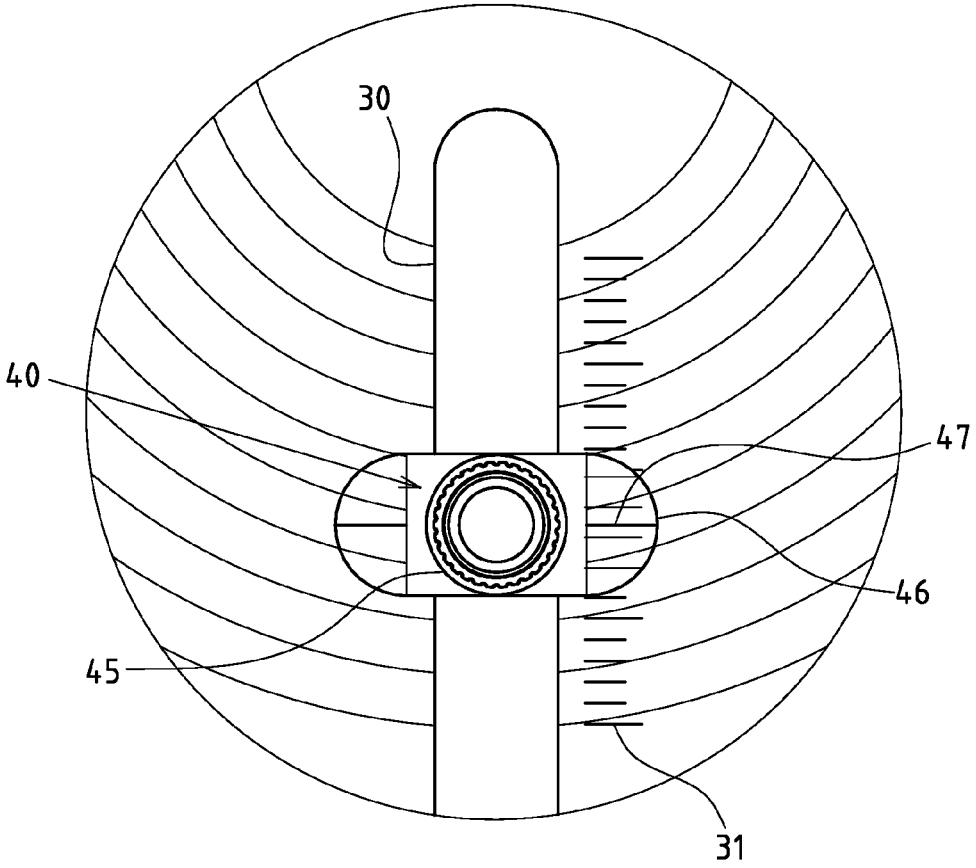
FIG. 4 is a schematic view of the present invention wherein a magnifier with index is set on the scale of the elongated through groove correspondingly to the adjustable elastic cutting assembly.
Figure 7:
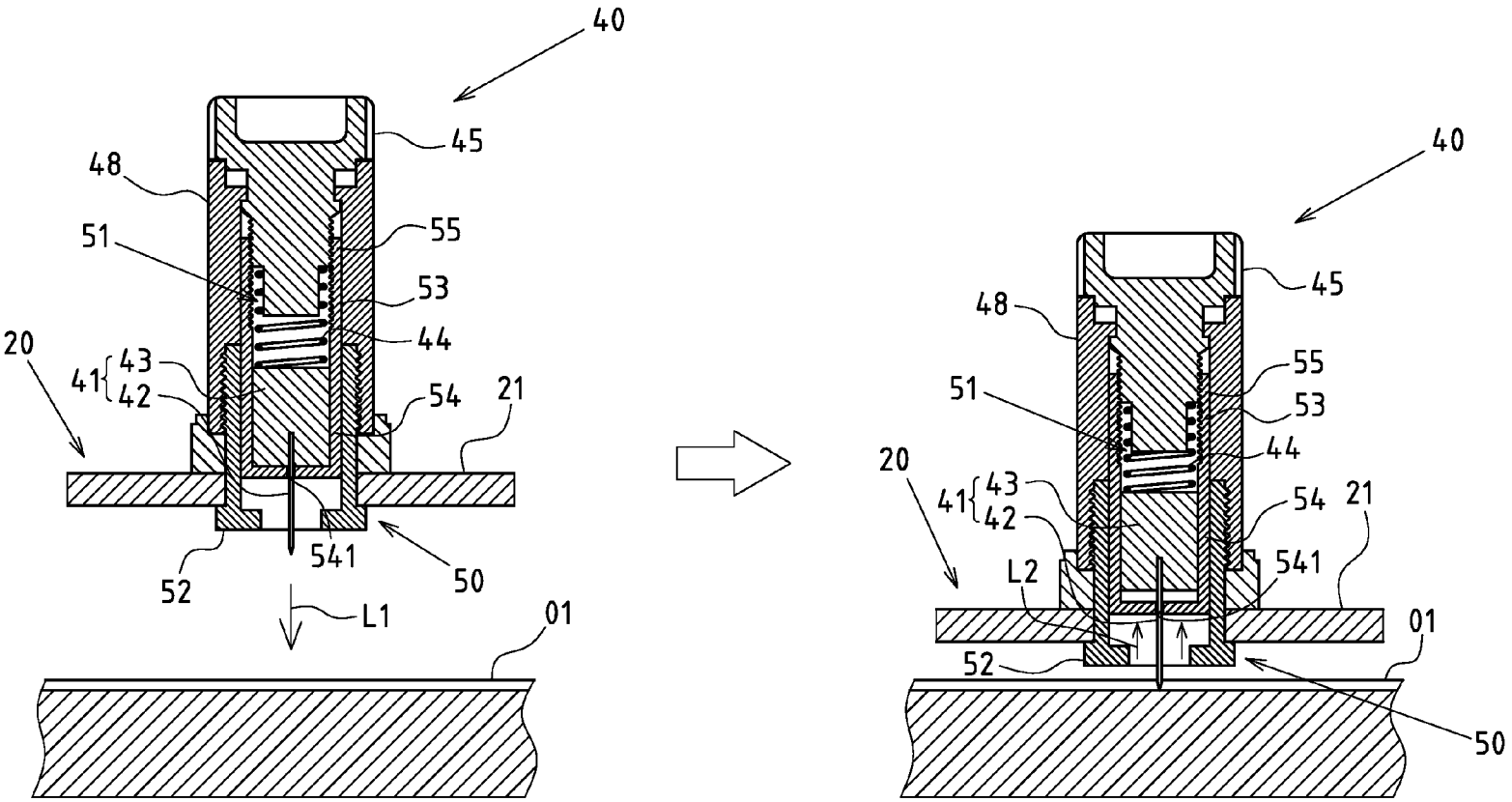
FIG. 7 is a schematic view of the present invention wherein the adjustable elastic cutting assembly could be adapted to the objects flexibly.
Figure 8:
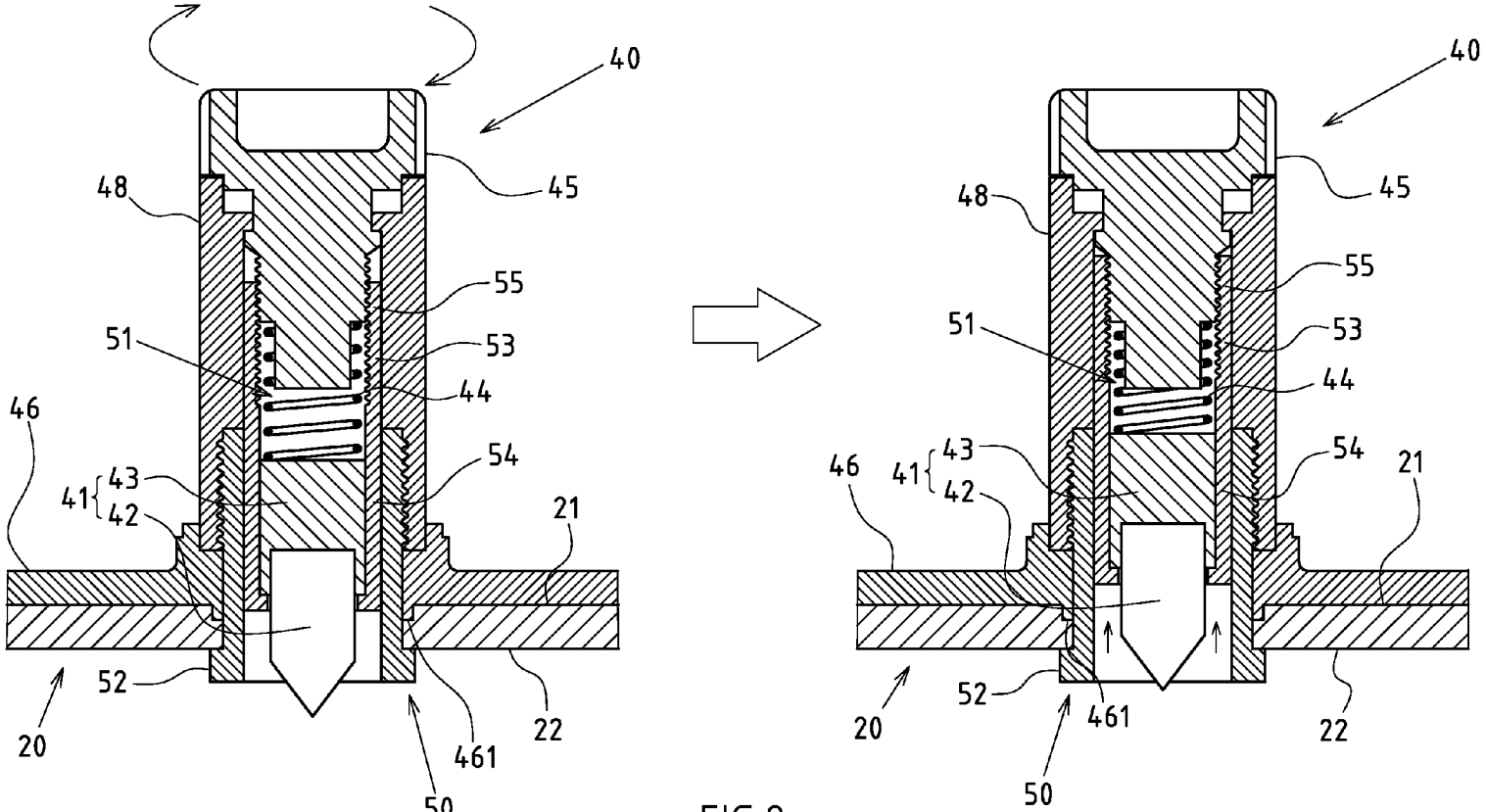
FIG. 8 is a schematic view of the present invention wherein the adjusting part could adjust the cutter for upward shift.

Referring to FIG. 4, a scale 31 is set at both sides of the elongated through groove 30, while a magnifier 46 with index 47 is set on the scale 31 of the elongated through groove 30 correspondingly to the adjustable elastic cutting assembly 40, so that the adjustable elastic cutting assembly 40 could slide oppositely to the scale 31 of the elongated through groove 30. Referring to FIGS. 3 and 7, the magnifier 46 could be screwed securely at both sides of the base body 52 of the holding base 50 by a spacing pipe 48. Of which, said index 47 could be designed into an extended line (shown in FIG. 4), such that the magnifier 46 can be aligned more accurately to the scale 31 of the elongated through groove 30. Referring also to FIG. 8, two bars 461 are set below the magnifier 46, so that the elongated through groove 30 could be locked by said bars 461, enabling more stable sliding of the adjustable elastic cutting assembly 40.

Figure 1:
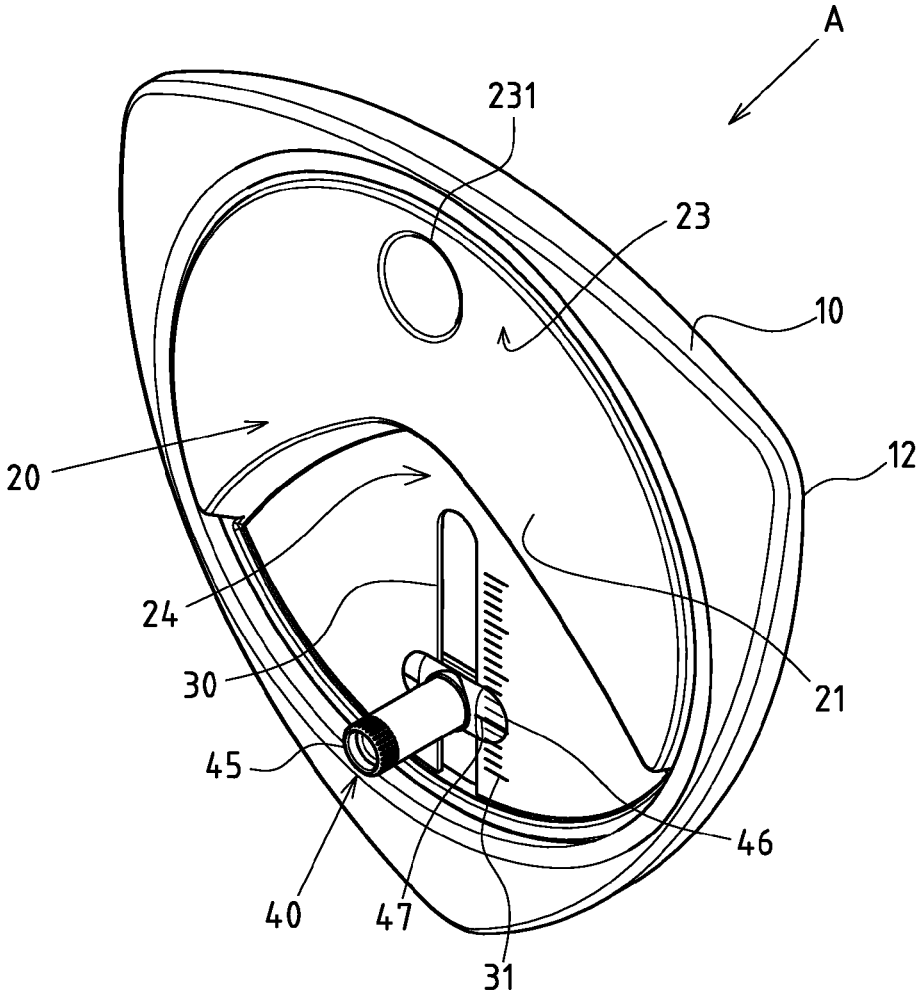
FIG. 1 is an assembled perspective view of the present invention.
Figure 5:
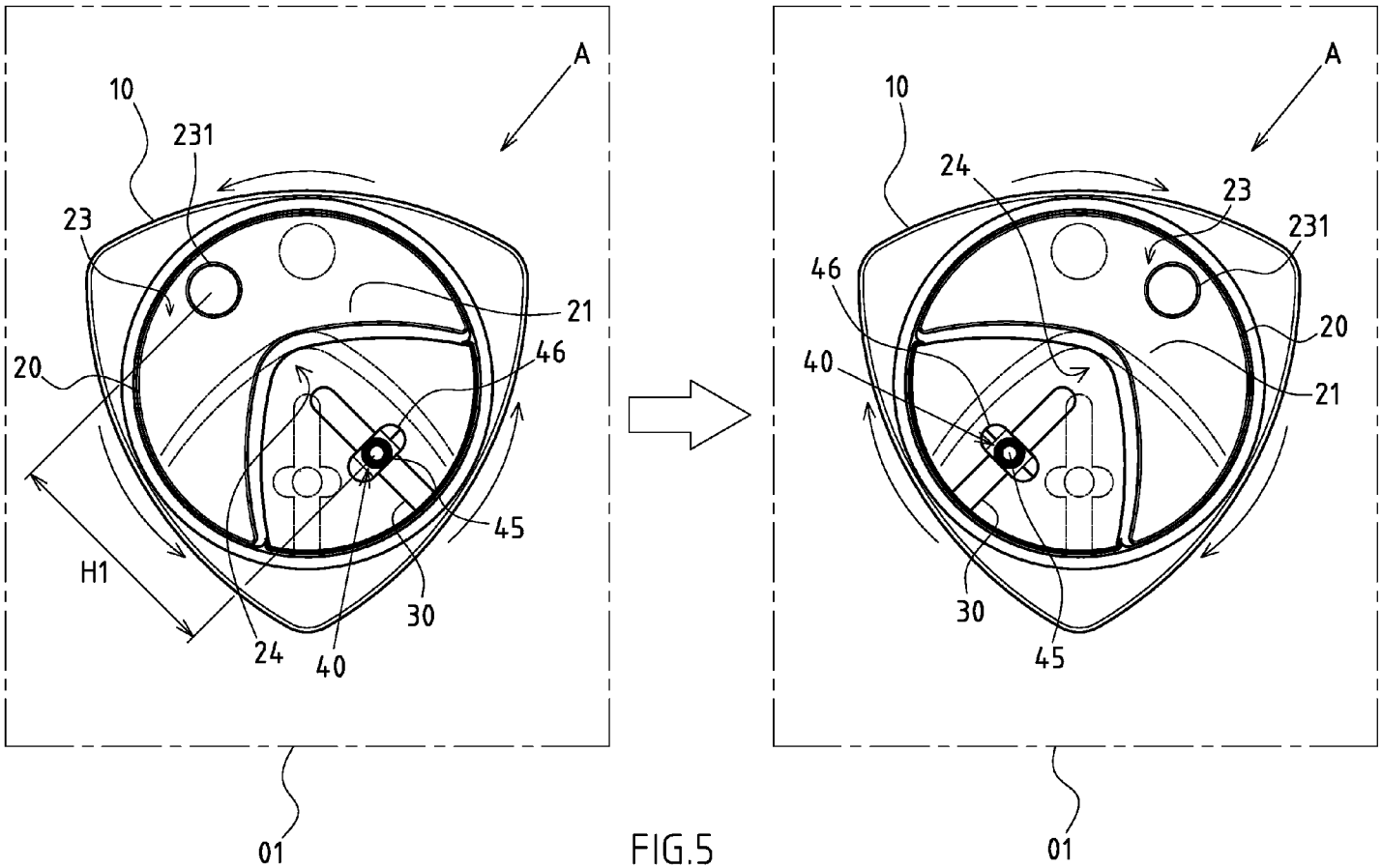
FIG. 5 is a top view of the present invention wherein the rotary disc is rotated through the rotary disc outer ring portion.
Figure 6:
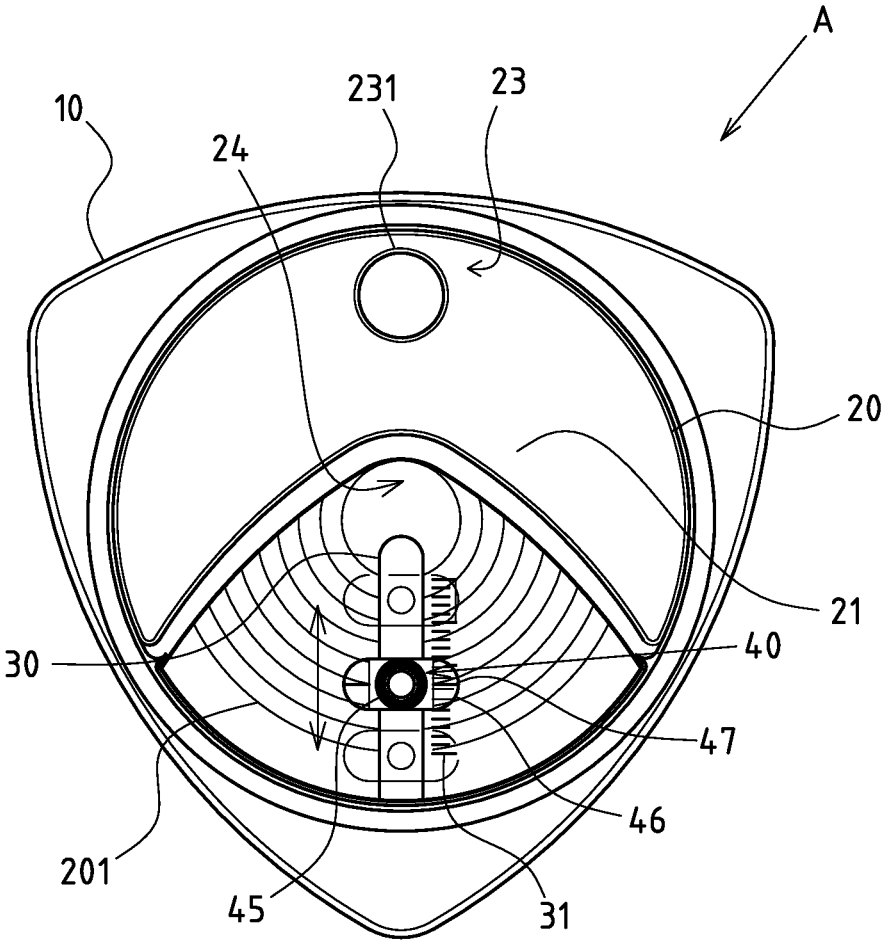
FIG. 6 is a schematic view of the present invention wherein the adjustable elastic cutting assembly could slide in the elongated through groove for adjusting purpose.

Referring to FIGS. 1 and 5, a concave edge 231 is set at the outer ring portion 23 of the rotary disc 20, such that the rotary disc 20 could rotate more smoothly. Referring to FIG. 6, some arced alignment lines 201 are set on said rotary disc 20, so that the users could identify clearly the exact circles within which the targeted objects are located, thus adjusting the scale 31 corresponding to the adjustable elastic cutting assembly 40.

Based on above-specified structural design, the present invention is operated as follows.

Referring to FIGS. 5, 6 and 7, prior to cutting by the circle-cutting tool A, the adjustable elastic cutting assembly 40 could slide in the elongated through groove 30, allowing to adjust the size of the circle to be cut (shown in FIG. 6). Next, the outer ring seat 10 could press the flat object 01 (FIG. 5 depicts a top view when the outer ring seat 10 presses the flat object 01; as also indicated by arrow L1 in left part of FIG. 7, the rotary disc 20 is also abutted onto the flat object 01). In such case, the cutter 41 will generate upward elastic force due to the pressing force (indicated by arrow L2 in right part of FIG. 7), thus enabling flexible cutting in line with the thickness of the flat object 01, without the difficulty of application of force arising from excessively deep insertion in the prior art. Next, referring to FIG. 5, the rotary disc 20 could be rotated for cutting through the concave edge 231 on the outer ring portion 23 of the rotary disc 20, such that optimum torque could be maintained in cutting big or small circles (said torque is shown by H1 in FIG. 5). If it is intended to cut thick objects, the rotary disc 20 could be rotated continuously by the adjustable elastic cutting assembly 40, permitting the downward cutting of the cutter 41 (note: the operating principle is similar to that in FIG. 7).

Referring to FIG. 8, the adjusting part 45 of the adjustable elastic cutting assembly 40 could be rotated to drive the vertical sliding of the driven tube 53 of the holding base 50 and the cutter 41 at the actuating end 54 of the driven tube 53, so the blade 42 of the cutter 41 is protruded out of the base body 52 for adapting to the targeted objects.

I claim:

1. A circle cutting apparatus comprising:

an outer ring seat having a round opening and a placing surface;

a rotary disc rotatably mounted in said round opening of said outer ring so as to rotate relative to said outer ring seat, said rotary disc having a top surface and a bottom surface and an outer ring portion and a central portion;

an elongated through groove formed radially through said rotary disc so as to open at said top surface and said bottom surface thereof, said elongated through groove extending from said central portion to said outer ring portion;

an adjustable elastic cutting assembly slidably mounted in said elongated through groove, said adjustable elastic cutting assembly comprising:

a holding base having a holding space therein;

a cutter slidably positioned in said holding space of said holding base, said cutter having a blade and a cutting base;

an elastic element positioned in said holding space of said holding base, said elastic element bearing against said cutting base of said cutter; and an adjusting part positioned in said holding space of said holding base, said adjusting part cooperative with said cutter so as to cause said cutter to slide relative to said holding base, said holding base having a base body and a driven tube slidably positioned in said base body, said holding space formed in said driven tube, said driven tube having an actuating end and a regulating end, said cutter positioned at said actuating end of said driven tube, said actuating end having a through-hole through which said blade of said cutter protrudes, said adjusting part being threadedly secured interior of said regulating end of said driven tube, said elastic element extending between said adjusting part and said cutter, said driven tube having a first radial spacing part extending outwardly therefrom such that said driven tube can slide in relation to said base body, said cutter having a second radial spacing part extending outwardly therefrom such that said cutter can slide in relation to said driven tube.

2. The circle cutting apparatus of claim 1, further comprising:

a scale positioned on opposite sides of said elongated through groove;

a magnifier having an index thereon, said magnifier positioned on said scale in correspondence to said adjustable elastic cutting assembly such that said adjustable elastic cutting assembly can slide oppositely of said scale.

3. The circle cutting apparatus of claim 1, said outer ring portion of said rotary disc having a concave edge.

* * * * *